United States Patent [19]

Waiser

[11] Patent Number: 4,699,117

[45] Date of Patent: Oct. 13, 1987

[54] CROSS BOW

[76] Inventor: Shimon Waiser, P.O. Box 360, Midwood Station, Brooklyn, N.Y. 11230

[21] Appl. No.: 810,193

[22] Filed: Dec. 18, 1985

[51] Int. Cl.[4] ..... F41B 5/00

[52] U.S. Cl. ..... 124/25

[58] Field of Search ..... 124/25, 23 R, 24 R, 124/20 B

[56] References Cited

U.S. PATENT DOCUMENTS

| | | | |
|---|---|---|---|
| 2,516,341 | 7/1950 | Raffeis | 124/25 |
| 3,561,419 | 2/1971 | Cucuzza | 124/25 |
| 4,091,790 | 5/1978 | Hoyt | 124/24 R |
| 4,169,456 | 10/1979 | Van House | 124/25 |
| 4,587,944 | 5/1986 | Barnett | 124/25 |

*Primary Examiner*—Richard C. Pinkham
*Assistant Examiner*—Benjamin Layno

[57] ABSTRACT

A cross bow has a bow prod including two symmetrical halves which are mounted on two symmetrical bow prod mounts. The bow prod mounts are pivotally mounted on a fore end portion of a cross bow stock and movably connected to a slide, the slide performs longitudinal motion, when the cross bow is being cocked, thereby turning the bow prod mounts so that when one of the mounts is turned clockwise by some angle, another one is turned counter clockwise by the same angle, so as to increase the distance between the ends of the bow prod halves to which a bow string is attached and to thereby increase a bow prod tension for shooting.

8 Claims, 5 Drawing Figures

CROSS BOW

BACKGROUND OF THE INVENTION

This invention relates to cross bows as used by sportsmen and hunters and more specifically to turnable or pivotable bow fastening devices and cocking devices for such cross bows.

A known cross bow has a rigidly mounted bow on the end of the stock which incorporates a trigger mechanism for releasing a taut bow string so as to shoot an arrow therefrom.

One considerable disadvantage of the known cross bow lies in the fact that the known cross bow has only one bow draw weight because the distance between each end of the bow prod and the bow string catch is the same for each particular cross bow.

Another disadvantage of the known cross bow lies in the fact that the known cross bow occupies too much space during transportation and storage because the cross bow prod is long and it is at least approximately perpendicular to the cross bow stock.

A further disadvantage of the known cross bow lies in the fact that in the known cross bow a string should not be connected to the bow prod for a long period of time because the bow prod can be deformed permanently and loses its capability of returning accumulated energy during a shot, if the bow prod has been bent during several months.

Still a further disadvantage of the known cross bow lies in the fact that it is not easy to return the bow string to its initial uncocked position without shooting, if desired, after the cross bow has been cocked.

SUMMARY OF THE INVENTION

Accordingly, it is an object of the present invention to provide a cross bow which avoids the disadvantage of the prior art and has a bow draw weight which is variable from maximum to zero.

Another object of the invention is to provide a cross bow with a bow prod consisting of two separate symmetrical halves or portions located on two symmetrical mounts which are pivotally mounted on a fore end portion of the cross bow stock that permits the two symmetrical bow halves or portions to take approximately parallel positions relatively to the cross bow stock for storage or transportation and also for avoiding a permanent deformation of the bow prod, when the string is permanently connected to the bow prod.

It is a further object of this invention to provide means in a cross bow for pivoting the bow prod mounts on the fore end portion of the cross bow stock for the purpose of cocking the cross bow.

It is also an object of the present invention to provide a cross bow with means for locking the symmetrical bow prod mounts, which are pivotally mounted on the cross bow stock, in different positions relatively to the cross bow stock for the purpose of creating different bow draw weights.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
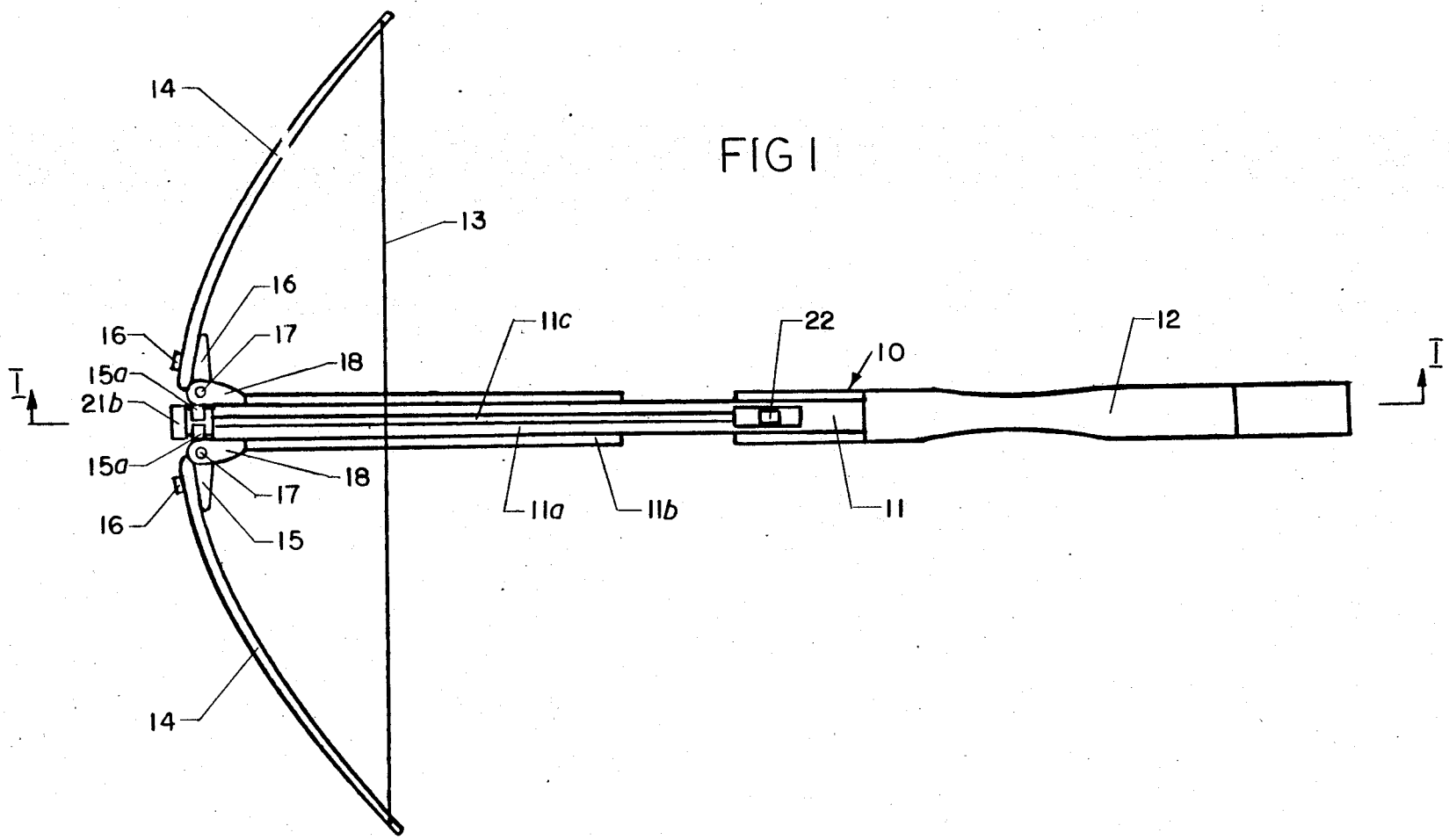
FIG. 1 is a top plan view of an inventive cross bow in a postshooting position.

A cross bow in accordance with the present invention comprises a stock 10 with a fore end portion 11 and a butt 12, a bow string 13, a bow prod 14 with two symmetrical halves or portions mounted on two symmetrical bow prod mounts 15 by two screws 16. The bow prod mounts 15 are pivotally mounted on the fore end portion 11 of the stock 10 by two pivot axles 17, which can be formed as rods, bolts, screws, etc.

The fore end portion 11 includes two main parts, namely, an upper part 11*a* and a lower part 11*b*, which are connected with two symmetrical parts 18. The parts 8 also serve as bow prod mounts supports to which the pivot axles 17 are immovably attached. The upper external surface of the upper part 11*a* of the fore end portion 11 has a guideway 11*c* along which a bolt can be projected by the string 13 or a bolt pusher when they are released from the catch. The lower part 11*b* of the fore end portion 11 is formed as a square tubing, plugged at the rear by square plug 19. This plug 19 has a central hole in which the rear cylindrical part of a screw or bolt 20 is disposed. The screw or bolt 20 has a head 20*a* projecting outside of the square plug 10. A movable slide 21 which has a threaded hole 21*a* is disposed inside the front end of the square tubing 11*b*. A front part of the screw 20 is located in the threaded hole 21*a*. A front part 21*b* of the slide 21 is located outside of the tubing 11*b* and contacts projections 15*a* of the bow prod mounts 15.

The bow prod mounts 15, the screw 20, the slide 21 and an additional ratchet wrench (not shown) which cooperates with the hexahedral head 20*a* of the screw 20 are the components of the cocking means. The screw 20 and the slide 21 are in addition the components of bow prod mounts locking means.

A catch 22 is pivotally mounted in the fore end portion 11 and is under the action of a spring (not shown). The catch 22 is mainly disposed within a slot which extends from the upper surface to the lower surface of the fore end portion 11. The catch 22 is held in a cocked position by a pivotally mounted trigger 23 which is under the action of a spring (not shown) and is also mainly disposed within the same slot in the fore end portion 11. A lower portion of the trigger 23 projects from the lower end of the slot so that it is accessible to a user. In the same slot under the left part of the trigger 25, a safety stem (not shown) and a safety stem fixing spring (not shown) are mounted. The safety stem is connected to a safety knob 24 which is located on a lateral external surface of the fore end portion 11 to be accessible to the user.

The inventive cross bow can fire both bolts and pellets, if respective projectile pushers are attached to the string. It also can fire bolts in a usual manner without using a bolt pusher. The following description will be based on the usual method of bolt shooting.

The inventive cross bow has three positions, namely, a precocked position, a cocked position and a post-shooting position.

The precocked position is a position in which the projecting parts of the bow prod mounts and the bow prod halves are turned backwards, so that the ends of the bow halves to which the bow string is connected are closer to the catch than they are in the postshooting position and the user can engage the string with the catch without great effort.

Figure 2:
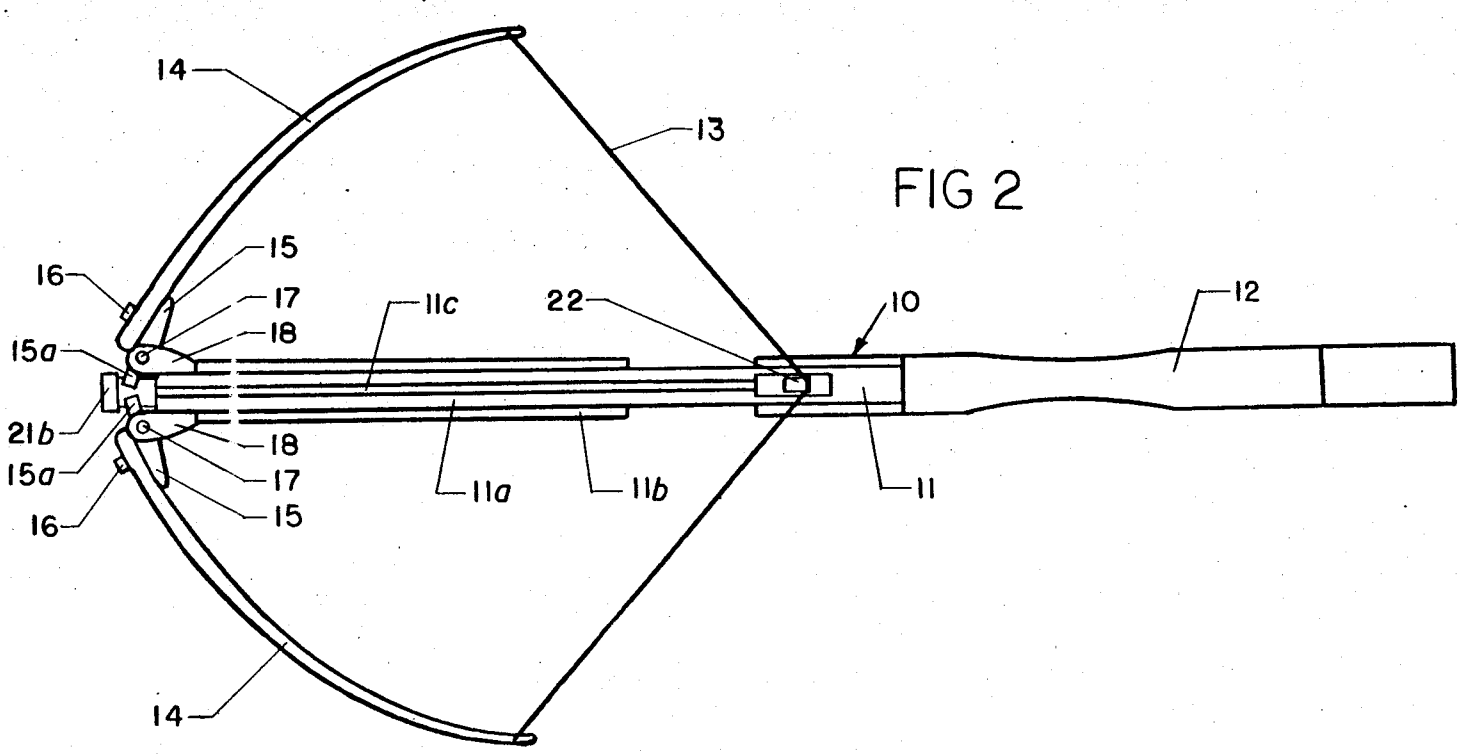
FIG. 2 is a top plan view of the cross bar in an intermediate cocked position.
Figure 4:
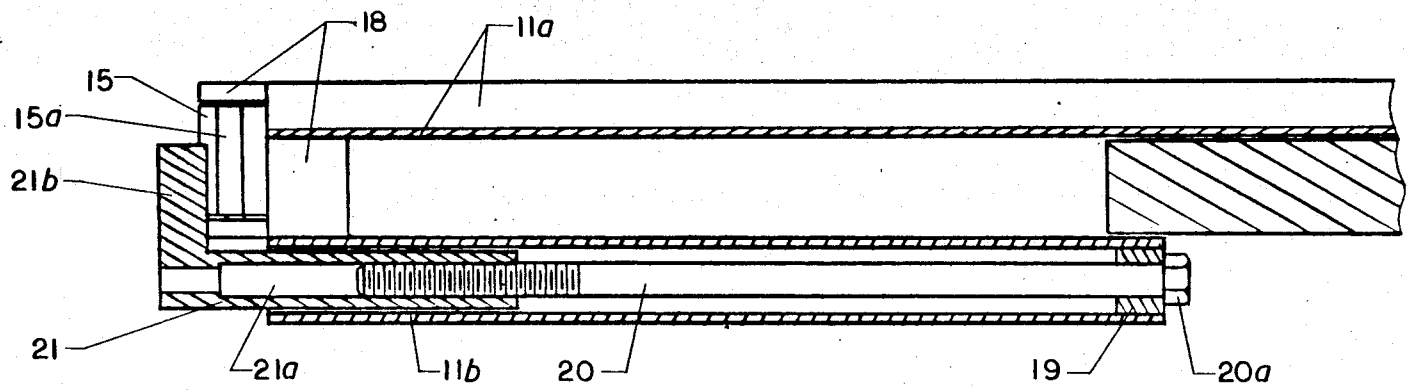
FIG. 4 is an enlarged fragmentary sectional view of the cross bow of FIG. 1 taken along line I—I with a bow prod and a string removed.
Figure 3:
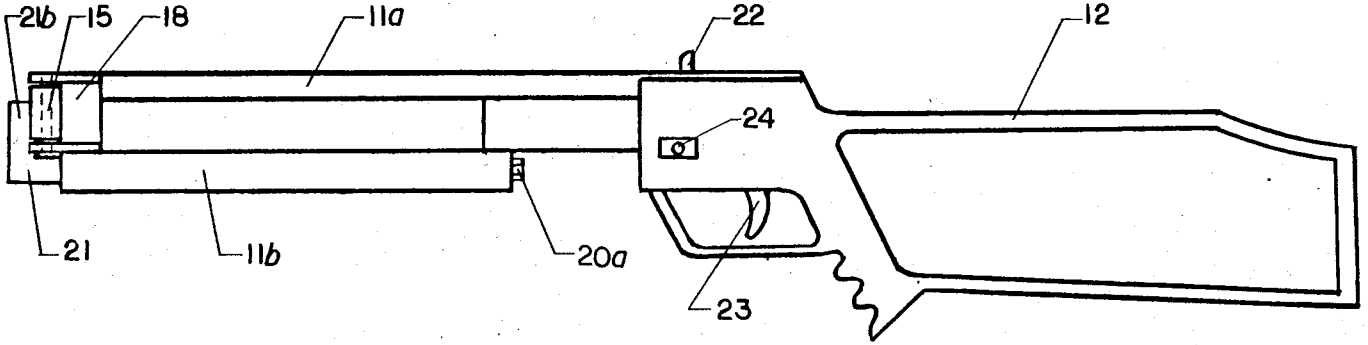
FIG. 3 is a side elevational view of the cross bow of FIG. 1 with a bow prod and a string removed.
Figure 5:
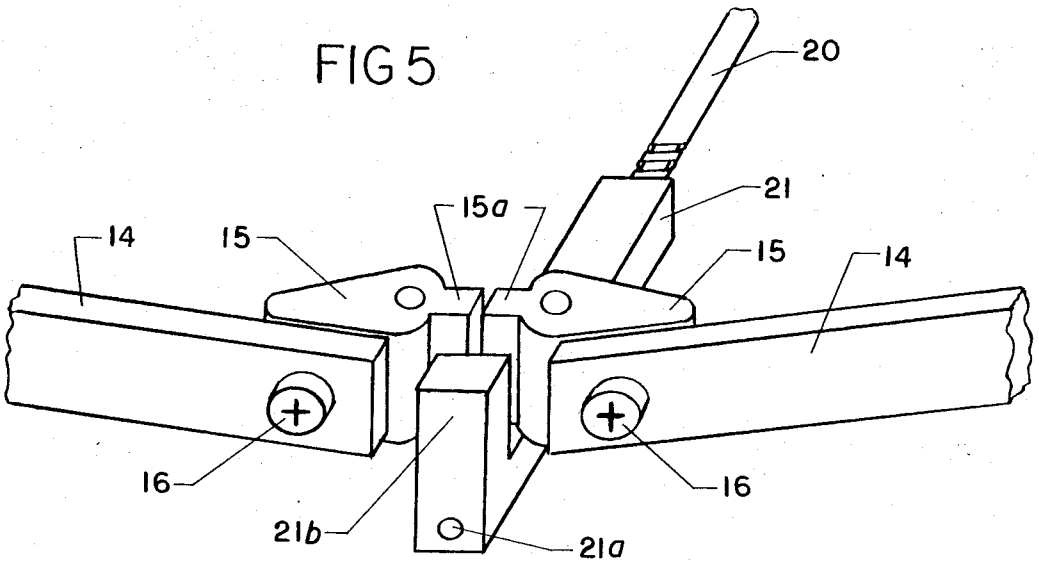
FIG. 5 is a perspective view of the relative position of bow prod halves, bow prod halves mounts, a bow prod mounts pulling slide and a slide moving screw in a working position.

The cocked position (see FIG. 2) is a position in which the projecting parts of the bow prod mounts and the bow prod halves are turned forward and the bow prod has tension for shooting, which is determined by the user.

The postshooting position (see FIG. 1) is a position in which the cross bow parts stay after a shot.

It is obviously that there are many precocked, cocked and postshooting positions.

OPERATION

For cocking the cross bow when it is in the post-shooting position, the user attaches a corresponding box-end reversible ratchet wrench to the head 20*a* of the screw 20 and starts to unscrew the screw 20 so that the slide 21 moves forward and thereby permit the turning of the bow prod mounts 15 and the bow prod halves 14, which are under the action of the bow prod tension, into the precocked position. When the user considers that he can easily engage the bow string 13 with the catch 22, he engages the bow string 13 with the catch 22. After this the user, using the box-end reversible ratchet wrench, starts screwing the screw 20 so that the slide 21 moves backwards such that part 21*b* contacts the bow prod mounts 15, turning the bow prod mounts 15 and the bow prod halves 14 to the cocked position. The user screws the screw 20 till the tension of the bow prod reaches the desired value. After this, the user places a bolt on its guideway 11*c* and the cross bow is ready to fire.

To fire the cross bow, the user uses the safety knob 24 and moves the safety stem (not shown) to the left to the "FIRE" position, disengaging it from the trigger 23. If after this the user turns the trigger 23 counter-clockwise, he disengages thereby the left upper part of the trigger 23 from the lower part of the catch 22. The catch 22 under the action of the bow string 13 will turn counter-clockwise and release the string 13, which together with the bolt is propelled forwardly. The catch spring immediately returns the catch 22 to its initial position and when the user releases the trigger 23, the trigger spring also returns the trigger 23 to its initial position. Now the cross bow is in the post-shooting position again, and for firing the next bolt the cycle has to be repeated.

It is to be understood that the inventive cross bow can be used without using the cocking means mentioned above. In this case the user, using the screw 20, places the slide 21 in a desired position and cocks the cross bow with bare hands by pulling the string 13 back into engagement with the catch 22. The firing procedure is the same as described above.

To store the cross bow, the user unscrews the screw 20 and thereby moves the slide 21 forward. The bow prod mounts 15 and the bow prod halves 14 are pivoted backwards to a position where the bow prod halves are at least approximately parallel to the cross bow stock 10. The cross bow can be kept in such a position indefinitely because there is no bow prod tension. Also, in this folded position the cross bow takes up a minimum amount of space.

In the described cross bow the tension from the slide 21 to the bow prod mounts 15 is transmitted by the projecting front part 21*b* of the slide 21. In another embodiment the tension can be transmitted from the slide 21 to the mounts 15 by using a metal rope connecting the mounts 15 to the slide 21. In this case the part 21*b* is not needed.

Instead of using the cocking and locking means described above, another type of cocking means can be used. There are hydraulic cocking and locking means which have the same components as a hydraulic car jack, i.e. a hydraulic cylinder, a hydraulic valve, a pumping lever and a ram which can be connected to the slide 21 or can form an integral part of the slide 21.

In the inventive cross bow the prod halves and the bow prod mounts corresponding to these prod halves can be formed integral of a one piece material.

It will be understood that each of the elements described above, or two or more together, may also find a useful application in other types of cross bows differing from the types described above.

While the invention has been illustrated and described as embodied in a cross bow, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cross bow, comprising a stock having a fore end portion;

a string;

a bow prod support having two bow prod halves mounts which are pivotally mounted on said fore end portion of said stock;

a resilient and flexible bow prod including two bow prod halves connected with said two bow prod halves mounts; and cocking means mounted on said fore end portion of said stock and arranged to turn simultaneously said bow prod halves mounts and thereby said bow prod halves in opposite directions so that when one of said bow prod halves mounts is turned clockwise by a predetermined angle, the other of said bow prod halves mounts is turned counter-clockwise by at least approximately the same angle so as to bend said two bow prod halves and therefore to build and increase a bow prod tension for shooting.

2. A cross bow as defined in claim 1, wherein each of said bow prod halves forms an integral member with a respective one of said bow prod halves mounts.

3. A cross bow as defined in claim 1, wherein said cocking means includes a threaded rod and a slide movably connected with said bow prod halves mounts so as to turn the latter and to thereby turn said bow prod halves, said slide having a threaded hole which corresponds to said threaded rod, said slide being formed so as to perform a longitudinal movement in response to screwing of said threaded rod into said threaded hole and unscrewing said threaded rod from said threaded hole.

4. A cross bow as defined in claim 3, wherein said slide has at least one projecting part which is arranged to contact said bow prod halves mounts so as to turn the latter in response to the longitudinal movement of said slide.

5. A cross bow, comprising a stock having a fore end portion;

a string;

a resilient flexible bow prod including two resilient flexible bow prod halves;

two bow prod halves mounts to which said bow prod halves are attached, said bow prod halves mounts being pivotally mounted on said fore end portion of said stock in such a manner as to permit, for changing of a bow prod tension, turnable symmetrical simultaneous motions of said bow prod halves mounts with said bow prod halves relative to said stock between a plurality of symmetrical positions; and locking means arranged for simultaneously fixing both said bow prod halves mounts during said turnable motions in each of said positions.

6. A cross bow as defined in claim 5, wherein each of said bow prod halves forms an integral member with a respective one of said bow prod halves mounts.

7. A cross bow, comprising a stock having a fore end portion;

a string;

a bow prod support having two bow prod halves mounts which are pivotally mounted on said fore end portion of said stock;

a bow prod including two bow prod halves connected with said two bow prod halves mounts;

said bow prod halves mounts and said bow prod halves being turnable relative to said stock between a plurality of positions in which different bow prod tensions are built;

locking means arranged for fixing said bow prod halves mounts in each of said positions; and cocking means mounted on said fore end portion of said stock and arranged to turn simultaneously said bow prod halves mounts and thereby said bow prod halves in opposite directions so that when one of said bow prod halves mounts is turned clockwise by a predetermined angle, the other of said bow prod halves mounts is turned counter-clockwise by at least approximately the same angle so as to bend said two bow prod halves and therefore to build and increase a bow prod tension for shooting.

8. A cross bow as defined in claim 7, wherein said locking means forms at least a part of said cocking means so that the latter also performs the fixing of said bow prod halves mounts in each of said positions.

* * * * *

UNITED STATES PATENT AND TRADEMARK OFFICE

CERTIFICATE OF CORRECTION

PATENT NO. : 4,699,117

DATED : October 13, 1987

INVENTOR(S) : Shimon Waiser

It is certified that error appears in the above-identified patent and that said Letters Patent is hereby corrected as shown below:

Column 1, line 38, "disadvantage" should read --disadvantages--.

Column 2, line 5, "bar" should read --bow--.

Column 2, line 30, "8" should read --18--.

Column 2, line 40, "10" should read --19--.

Column 2, line 64, "25" should read --23--.

Signed and Sealed this

Twenty-fifth Day of July, 1989

*Attest:*

DONALD J. QUIGG

*Attesting Officer*

*Commissioner of Patents and Trademarks*